US005877452A

United States Patent [19]

McConnell

[11] Patent Number: 5,877,452

[45] Date of Patent: *Mar. 2, 1999

[54] COAXIAL CABLE CONNECTOR

[76] Inventor: David E. McConnell, 6090 McDonough Dr. Suite D, Norcross, Ga. 30093

[ * ] Notice: This patent issued on a continued prosecution application filed under 37 CFR 1.53(d), and is subject to the twenty year patent term provisions of 35 U.S.C. 154(a)(2).

[21] Appl. No.: 815,967

[22] Filed: Mar. 13, 1997

[51] Int. Cl.[6] ..... H01R 9/07

[52] U.S. Cl. ..... 174/88 C; 439/585

[58] Field of Search ..... 174/88 C, 88 S, 174/89; 439/578, 579, 580, 581, 582, 583, 584, 585

[56] References Cited

U.S. PATENT DOCUMENTS

| | | | |
|---|---|---|---|
| 2,762,025 | 9/1956 | Melcher | 439/580 |
| 3,810,076 | 5/1974 | Hutter | 439/585 |
| 4,400,050 | 8/1983 | Hayward | 439/585 |
| 4,408,821 | 10/1983 | Forney, Jr. | 439/387 |
| 4,452,503 | 6/1984 | Forney, Jr. | 439/585 |
| 4,540,231 | 9/1985 | Forney, Jr. | 439/306 |
| 4,593,964 | 6/1986 | Forney, Jr. et al. | 439/580 |
| 4,613,199 | 9/1986 | McGeary | 439/585 |
| 4,616,900 | 10/1986 | Cairns | 350/96.2 |
| 4,835,342 | 5/1989 | Guginsky | 174/65 SS |
| 4,921,447 | 5/1990 | Capp et al. | 439/585 |
| 4,990,106 | 2/1991 | Szegda | 439/585 |
| 5,073,129 | 12/1991 | Szegda | 439/585 |
| 5,083,943 | 1/1992 | Tarrant | 439/583 |
| 5,120,260 | 6/1992 | Jackson | 439/585 |
| 5,154,636 | 10/1992 | Vaccaro et al. | 439/583 |
| 5,227,587 | 7/1993 | Paterek | 174/152 GM |
| 5,295,864 | 3/1994 | Birch et al. | 439/578 |
| 5,334,051 | 8/1994 | Devine et al. | 439/583 |
| 5,338,225 | 8/1994 | Jacobsen et al. | 439/585 |
| 5,499,934 | 3/1996 | Jacobsen et al. | 439/585 |
| 5,644,104 | 7/1997 | Porter et al. | 174/65 R |
| 5,667,405 | 9/1997 | Holliday | 439/585 |

*Primary Examiner*—Kristine Kincaid
*Assistant Examiner*—Chau N. Nguyen
*Attorney, Agent, or Firm*—Troutman Sanders, LLP

[57] ABSTRACT

An end connector for coaxial cable, attached thereto by a compression crimp urging engagement between a threaded inner wall of an outer sleeve of the connector and utilizing a deformable O-ring captively positioned between a backside of a ground conductor plate and an inner edge of an inwardly flanged shoulder portion of a connector nut. Upon connection of the connector of the present invention to its mating connector, pressure applied to the ground plate platform deforms the O-ring, thereby urging improved electrical contact between ground plate platforms of respective connectors while preventing introduction of unwanted contaminants into the conductor.

16 Claims, 1 Drawing Sheet

COAXIAL CABLE CONNECTOR

FIELD OF THE INVENTION

This invention relates to devices for connecting one end of a coaxial cable to a second coaxial cable end, post or terminal commonly used in cable television (CATV) systems. More particularly, this invention relates to a novel and improved means for electrically and mechanically securing one coaxial cable end to its mated fitting.

BACKGROUND OF THE INVENTION

As the capability and capacity of CATV transmission and receiving systems increase, so does the need for connection means between the two which minimize signal loss.

Conventional CATV signals are transmitted via coaxial cable generally characterized by inner and outer conductors. The inner and outer conductors are separated by a dielectric insulator and externally covered by an outer jacket constructed of a weather and impact resistant material, such as rubber. Coaxial transmission cables must be connected either to another coaxial cable or a mating post or terminal on a receiving device such as a television. Numerous connectors have been devised to obtain such a mechanical and electrical connection.

Typical connectors comprise a pair of tubular elements coaxially extending from the body of a connector fitting. During attachment to the coaxial cable end, the outer conductor of the cable is received within the outer tubular element ("outer sleeve") of the connector. Simultaneously, the inner tubular element ("inner sleeve") of the connector is forced between the dielectric and the outer conductor of the cable end. Subsequently, the outer sleeve of the connector is constrictively crimped for fixation to the cable end.

Historically, infiltration of moisture or other environmental elements and poor connection of opposing conducting surfaces have been the most significant sources of signal loss. Until recently, hexagonal crimp configurations were most commonly used to attach connectors to cable ends. This type of crimp often failed to provide a uniform seal around the periphery of the connector, thereby resulting in a gap between connector and cable jacket. Moisture and/or dust could then be introduced into the conductive portion of the connector. Similarly, infiltration of moisture occurs because of the necessarily loose fit of a connector nut on the body of the connector. The connector nut allows the screwing of the connectorized cable end onto a mating connector.

Poor connection between conductive aspects of mating connectors is equally detrimental to signal integrity. For example, if the connector is not fastened securely to its mating connector, there will not be optimum conductive contact between the respective ground conductors of the respective coaxial cables. Such poor connection results in signal distortion. Less than optimum connection can also occur by the loosening of the connectors due to vibration, repeated change in environmental conditions, etc.

Recent improvements in connector technology have addressed these problems. So-called "compression" crimps are gaining wide acceptance in the CATV industry as a means for drastically limiting the amount of moisture, etc., that leaks into the cable end of a connector. A compression crimp deforms the outer sleeve of the connector essentially uniformly around its periphery. Such uniform compression assures that the outer sleeve engages the pliable outer jacket of the coaxial cable without gaps between the connector and cable end. Additionally, inner walls of connector outer sleeves now typically incorporate mechanisms for enhancing the post-crimp sealed engagement between outer sleeve of conductor and outer jacket of cable end.

Further improvements in connector performance relate to the implementation of an O-ring within the nut portion of the connector. U.S. Pat. No. 5,083,943 (the '943 patent) employs two separate O-rings. These O-rings formed of a pliable material resistant to and recoverable from deformation, such as rubber provide an improved barrier from external agents which could compromise connector performance. One of the O-rings of the '943 patent is sandwiched between the fixed inner and turnable outer ("nut") portion of the connector. The second O-ring of the '943 patent is captively seated in a groove proximate to the termination of the screw-receiving grooves on the inner portion of the nut portion of the connector. The second O-ring exerts an opposing force against the mating connector when compressed, as during engagement of mating connectors. This force is easily overcome during the process of engagement and encourages continued engagement between threaded and thread receiving aspects of opposing mating connectors.

One notable problem exists with the position of the second O-ring of the '943 patent. The opposing force resulting from compression of the O-ring also encourages separation between the attached connectors and threatens to diminish connective contact between the inner, conductive portions of the respective connectors and cables.

As such, there is a need for an end connector for coaxial cable which provides an essentially element-proof connection between coaxial cable ends. Additionally, there is a need for such connector wherein such weatherproofing does not adversely affect the electrical conduction characteristics of the connector. There is a further need for a connector in which the weatherproofing elements, themselves, maximize the electrical conduction characteristics of the connectors.

SUMMARY OF THE INVENTION

As will be seen, the present invention satisfies the foregoing criteria. Stated generally, the connector minimizes or eliminates infiltration of the connector by unwanted contaminants. Concurrently, the connector encourages distortionless electrical contact. In particular, the connector incorporates a deformable O-ring captively positioned within one connector portion. Compression of the O-ring by a mating connector encourages electrical connection between conductive portions of the mating connectors. Such O-ring compression also provides a barrier against infiltration of the conductive elements of the connector by outside sources, such as dust and moisture. Additionally, the connector incorporates screw-type threads on the inner surface of the outer sleeve of the connector. These threads, when compressed into the pliable outer surface of a cable, form a sealed engagement between the connector and the cable. Another aspect of the connector is the ability to use the screw-type threads to screw the connector onto a cable end.

The connector of the present invention comprises a base portion, an attachment portion, a "ground conductor" and an O-ring. The base portion or "outer sleeve", formed of a rigid but deformable metal alloy, is cylindrical and defines an inner space sized to receive a coaxial cable end. The inner surface of the cylindrical base portion incorporates screw-type threads to facilitate weatherproofing characteristics of the connector and attachment of the connector to a cable end. A cylindrical inner sleeve referred to as the "ground conductor" is disposed within the inner space and about the same axis as the base portion. It is understood that the term "ground conductor" refers only to an arbitrarily established electrical reference. There is nothing unique to the inner sleeve which mandates or limits its use to that of a "ground conductor" only.

The ground conductor is sized to receive an insulating dielectric and inner conductor of the coaxial cable. The end of the ground conductor opposite the point of insertion of the cable is defined by an integrally formed ground plate platform. The integrally formed ground plate platform radiates outwardly from the cylindrical ground conductor in a plane perpendicular to the ground conductor axis. The leading edge of the ground plate platform makes electrically conductive contact with an opposing conductor within the mating connector when mating connectors are joined.

The attachment portion is also cylindrical and provides a means by which the connector can be physically connected to a mating connector. The outer surface of the attachment portion is nut-shaped for ease of turning—either manually or by a tool such as a wrench. The inner surface is tooled to receive a screw-threaded outer portion of the mating connector. The end of the attachment portion opposite the point of insertion of the mating connector is flanged inwardly. The inward flange forms a shoulder which defines a narrower opening. Both ground conductor and base portion of the connector pass through the narrower opening.

The deformable O-ring is captively positioned between the ground plate platform, the inner aspect of the shoulder of the attachment portion and the base portion.

The ground portion of the mating connector makes contact with the ground plate platform of the present invention during connection of mating connectors. As the connection is tightened by rotation of the attachment portion about the threaded mating connector, the O-ring is compressed. Compression of the O-ring provides two results. First, the resilient properties of the O-ring generate increased pressure on the backside of the ground plate platform as the connection between mating connectors is tightened. This increased pressure forces the opposing ground connectors together and enhances their electrical connection. Second, compression of the deformable O-ring creates an environmental seal between the inner aspect of the shoulder of the attachment portion and the backside of the ground plate platform. This environmental seal protects the conductive elements of the connected cable ends from infiltrates such as dust and moisture.

DETAILED DESCRIPTION

Figure 1:
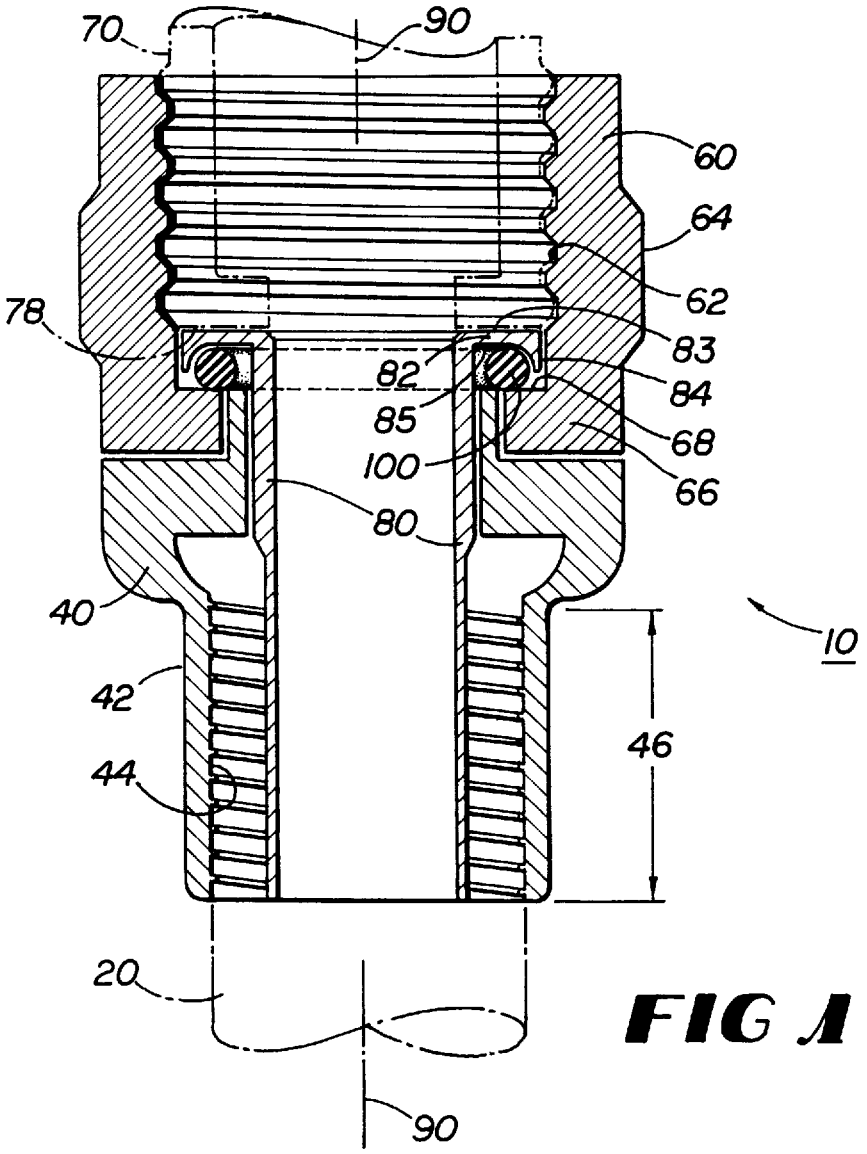
FIG. 1 is a diagram of an exemplary embodiment of the present invention.
Figure 2:
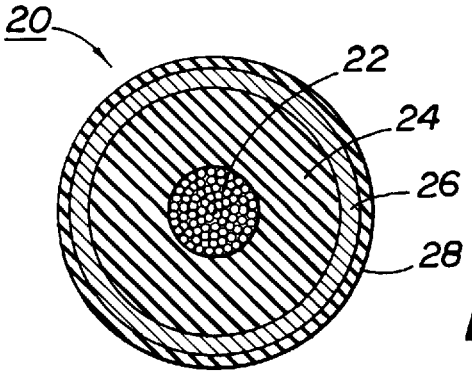
FIG. 2 is a cross sectional view of a typical coaxial cable.

Referring now to the drawings, in which like numerals indicate like elements throughout the various figures, FIG. 1 shows an end connector 10 in accordance with an exemplary embodiment of the present invention. Connector 10 comprises a base portion 40, an attachment portion 60, a ground conductor 80 and an O-ring 100. For illustrative purposes, a coaxial cable 20 is prepared for insertion into connector 10. FIG. 2 depicts a cross-sectional area of coaxial cable 20. Coaxial cable of this type comprises, generally, an electrical inner conductor 22 surrounded by a dielectric insulator 24. The dielectric insulator 24 separates inner conductor 22 from outer conductor 26. The outer conductor 26 is covered with a protective, pliable jacket 28 made of a material such as rubber.

The base portion 40 of connector 10 is generally cylindrical and comprises an outer jacket 42. Outer jacket 42 may have a screw-threaded inner wall 44. The diameter of the base portion 40 is such that it will receive cable end 20. The base portion 40 is constructed of a rigid but bendable material such as a metal alloy, and its wall thickness is significantly less at its receiving end, shown generally along length 46.

Cylindrical attachment portion 60 is captively and rotatably attached to the end of base portion 40 opposite the point of insertion of coaxial cable 20. Attachment portion 60 comprises a threaded inner wall 62 for receiving a mating connector, an external surface 64 and an inwardly flanged shoulder portion 66. The external surface 64 of attachment portion 60 can be shaped as a nut or otherwise formed to allow ease of manual turning about its axis of rotation 90.

Cylindrical ground conductor 80 is disposed within the cavity defined by the inner wall 44 of base portion 40. Ground conductor 80 is longer than base portion 40 such that the end of ground conductor 80 opposite the cable insertion end of base portion 40 extends beyond the base portion 40. The extending end of ground conductor 40 radiates outwardly in a plane perpendicular to axis 90, thereby defining ground plate platform 82. In an exemplary embodiment, the outer edge of outwardly radiating ground plate platform 82 adjacent to threaded inner wall 62 of attachment portion 60 is defined by a downwardly turned outer portion 84. The downwardly turned outer portion 84 is integral to the ground plate platform 82 having a first planar side 83 and a second planar side 85. Upon completion of the mating of the connectors the downwardly turned outer portion 84 prevents excessive deformation of O-ring 100 by butting against the inner edge of inwardly flanged shoulder portion 66.

In the exemplary embodiment, the O-ring 100 is captively positioned in a cavity defined on three sides by: (1) the ground plate platform 82; (2) the downwardly turned and integrally formed outer portion 84 of the ground plate platform 82; and (3) the cylindrical ground conductor 80. The cylindrical ground conductor 80 is integral to the inner edge of the ground plate platform 82. The cylindrical ground conductor 80 is positioned about axis 90 and extends from its connection to the inner edge of the ground plate platform 82 to the cable insertion end of the base portion 40. The cylindrical ground conductor 80 is sized to receive the inner dielectric of the coaxial cable 20. The fourth side of the cavity in which the O-ring is disposed is defined by the inner shoulder surface 68 of the inwardly flanged shoulder portion 66 of the attachment portion 60 of the connector 10.

The connector 10 is affixed to coaxial cable end 20 by first inserting the cable end 20 into the cylindrical opening in the base portion 40. Compressive force is then applied to the outer sleeve 42 of the base portion 40. The compressive force is applied substantially uniformly about the surface of the outer jacket 42 and along the length of the base portion 40, as generally indicated by dimension 46. The compressive force deforms the outer jacket 42 of base portion 40 such that the screw-threaded inner wall surface 44 of base portion 40 is compressed into the pliable outer jacket of cable end 20. This compression, when completed, creates a seal resistant to compromise by elements, natural or otherwise.

In operation, the attachment portion 60 of connector 10 is rotated about axis 90 as mating connectors are introduced. Electrically conductive contact is made between ground plate 82 and the corresponding portion of the mating connector as the mating connector is captively drawn into connector 10 via threaded inner wall 62. Ground plate platform 82 is forced against O-ring 100 as attachment portion 60 is further rotated and connection between the connector 10 and the mating connector tightened. O-ring 100 is thereby forced against inner shoulder surface 68 of inwardly flanged shoulder portion 66 of attachment portion 60. Sufficient tightening of the connector 10 to the mating connector results in compressive deformation of O-ring 100, providing both an environmental barrier between the connector 10 and its mating connector. Additionally, static force applied to the underside of the ground plate 82 by compressed O-ring 100 provides enhanced conductive contact between ground plate 82 and the corresponding portion 78 of the mating connector 70.

While this invention has been described in detail with particular reference to exemplary embodiments thereof, it will be understood that variations and modifications can be effected within the spirit and scope of the invention as described hereinabove and as defined in the appended claims.

I claim:

1. An end connector for a coaxial cable, comprising:

radially inner and outer spaced generally cylindrical sleeves, open at a first end, the inner sleeve being sized to receive at the first end an inner conductor and an annular dielectric of the coaxial cable, the outer sleeve being sized to receive an outer conductor and an insulating jacket of the coaxial cable, and coupling means for coupling connectors having an inner and an outer surface, the inner surface formed to captively accept a matingly corresponding outer surface of a mating connector, the coupling means being attached to the radially inner and outer spaced sleeves at their second ends, an annular conductive surface integral to the inner sleeve, disposed at the second end of the inner sleeve and extending radially outwardly in a plane essentially perpendicular to the axis about which the inner and outer sleeves are disposed, the annular conductive surface having a first planar side and a second planar side the first planar side being positioned for contact with a corresponding, inner conductive surface of the mating connector an O-ring disposed about the inner sleeve adjacent to the second planar side of the annular conductive surface and the inner surface of the coupling means, the O-ring forming an environmental seal therebetween upon coupling by the coupling means with the corresponding mating connector, which coupling means compresses the second planar side of the annular conductive surface and the O-ring into a sealed arrangement with the coupling means, and means for affixing the end connector to the coaxial cable.

2. The end connector of claim 1 wherein the outer perimeter of the annular conductive surface extends backwardly toward the first end of the inner sleeve opposite the annular surface in a manner so as to be perpendicular, at any given point, to the annular surface, thereby forming an annular groove about the inner sleeve said groove defined on three sides by the exterior of the inner sleeve, the annular surface and the backwardly extending portion.

3. The end connector of claim 2 wherein the O-ring is disposed within the annular groove.

4. The end connector of claim 1 wherein the O-ring is formed of a pliable material resistant to and recoverable from deformation, said material is also resistant to deterioration from exposure to environmental elements.

5. The end connector of claim 1 wherein the affixing means comprises an inner surface of the outer sleeve having screw-type threads disposed thereon, said threads, when compressed onto the insulating jacket of the coaxial cable, create an environmental seal.

6. The end connector of claim 5 wherein the threads are disposed along substantially the entire length of the inner surface of the outer sleeve.

7. The end connector of claim 1 wherein the end connector is attached to the coaxial cable by a compression-type crimp.

8. The end connector of claim 7 wherein the compression-type crimp is applied uniformly along substantially the entire length of the outer surface of the outer sleeve.

9. An end connector for a coaxial cable, comprising:

radially inner and outer spaced generally cylindrical sleeves, open at a first end, the inner sleeve being spaced to receive at the first end an inner conductor and an annular dielectric of the coaxial cable, the outer sleeve being sized to receive an outer conductor and an insulating jacket of the coaxial cable, and coupling means for coupling connectors having an inner and outer surface, the inner surface formed to captively accept a matingly corresponding outer surface of a mating connector, the coupling means being attached to the radially inner and outer spaced sleeves at their second end, an annular conductive surface integral to the inner sleeve, disposed at the second end of the inner sleeve and extending radially outwardly in a plane essentially perpendicular to the axis about which the inner and outer sleeves are disposed, wherein the outer perimeter of the annular conductive surface extends backwardly toward a cable insertion end of the outer sleeve in a manner so as to be generally perpendicular to the annular surface; and means for affixing the end connector to the coaxial cable.

10. The end connector of claim 9 further comprising a deformable O-ring disposed about the inner sleeve adjacent to the annular conductive surface.

11. The end connector of claim 10 wherein the O-ring is located within an annular groove defined on three sides by the exterior of the inner sleeve, the annular surface and the backwardly extending portion.

12. The end connector of claim 10 wherein the O-ring is formed of a pliable material resistant to and recoverable from deformation, said material is also resistant to deterioration from exposure to environmental elements.

13. The end connector of claim 9 wherein the affixing means comprises an inner surface of the outer sleeve having screw-type threads disposed thereon, said threads, when compressed onto the insulating jacket of the coaxial cable, create an environmental seal.

14. The end connector of claim 13 wherein the threads are disposed along substantially the entire length of the inner surface of the outer sleeve.

15. The end connector of claim 9 wherein the end connector is attached to the coaxial cable by a compression-type crimp.

16. The end connector of claim 15 wherein the compression-type crimp is applied uniformly along substantially the entire length of the outer surface of the outer sleeve.

* * * * *